US006939180B1

(12) United States Patent
Wu

(10) Patent No.: US 6,939,180 B1
(45) Date of Patent: Sep. 6, 2005

(54) RECEPTACLE FOR EXTENSION CORD

(76) Inventor: Sidney Wu, 9F, 738, Chung Cheng Rd., Chungho, Taipei (TW)

( * ) Notice: Subject to any disclaimer, the term of this patent is extended or adjusted under 35 U.S.C. 154(b) by 0 days.

(21) Appl. No.: 11/061,031

(22) Filed: Feb. 22, 2005

(51) Int. Cl.[7] ..... H01R 33/92
(52) U.S. Cl. ..... 439/650
(58) Field of Search ..... 439/650, 535–536, 439/538, 502, 646, 214

(56) References Cited

U.S. PATENT DOCUMENTS 5,429,518 A * 7/1995 Chen ..... 439/188
5,482,478 A * 1/1996 Liao ..... 439/622
5,526,225 A * 6/1996 Wang ..... 361/643
6,045,399 A * 4/2000 Yu ..... 439/502
6,483,028 B2 * 11/2002 DeBartolo et al. ..... 174/48

* cited by examiner

*Primary Examiner*—J. F. Duverne

(57) ABSTRACT

A receptacle for extension cord includes a housing having multiple slot pairs and an opening; multiple metal conducting strips seated in the housing to connect to core wires of a power cord in front of the housing; and a control unit including a key pivotally mounted in the opening on the housing, a conducting link strip seated in a slit on the key with a front portion fixed to a front side of the opening to connected to a core wire of the power cord, and a curved conducting spring strip connected at a front end to the conducting link strip and at a rear end to a point behind the opening. When the key is pushed, it biases the conducting link strip to contact with one of the metal conducting strips, so that external power source is supplied to the metal conducting strip via the power cord.

6 Claims, 5 Drawing Sheets

RECEPTACLE FOR EXTENSION CORD

FIELD OF THE INVENTION

The present invention relates to a receptacle for extension cord, and more particularly to a receptacle for extension cord that has simplified structure to allow easy assembling and reduced cost thereof.

BACKGROUND OF THE INVENTION

FIG. 1 shows a conventional receptacle for extension cord, which mainly includes a housing 10, a set of metal conducting strips 20, and a control switch 30. The housing 10 consists of a front cover 101 and a back cover 102 that are closed to each other, and is connected at a front end to a power cord 103, a distal free end of which is a plug 104 adapted to connect to an external power source. The set of metal conducting strips 20 includes a plurality of metal conducting strips, each of which is provided between two ends with a plurality of clampers. The metal conducting strips are separately fixedly seated in the housing 10 with the clampers separately aligned with slots provided on the front cover 101 of the housing 10. The metal conducting strips are directly or indirectly coupled with corresponding core wires of the power cord 103. The control switch 30 is mounted between the power cord 103 and one of the metal conducting strips for controlling an electrical connection of the external power source to the set of metal conducting strips 20. The following disadvantages are found in the above-described conventional receptacle for extension cord:

1. The receptacle for extension cord itself is a low-price product, and the control switch 30 is usually very expensive to prevent the receptacle from being manufactured at a reduced cost. The conventional receptacle for extension cord is therefore less competitive in the market; and
2. The core wires of the power cord 103 are connected to the set of metal conducting strips 20 and the control switch 30 byway of welding, which increases time and labor in assembling the receptacle to adversely affect the production efficiency of the receptacle.

It is therefore tried by the inventor to develop an improved receptacle for extension cord to overcome the drawbacks existed in the conventional products.

SUMMARY OF THE INVENTION

A primary object of the present invention is to provide a receptacle for extension cord that includes a structurally simplified control unit consisting of a key, a conducting link strip, and a curved conducting spring strip to replace the conventional control switch, and therefore has reduced manufacturing cost to be more competitive in the market.

Another object of the present invention is to provide a receptacle for extension cord that includes metal conducting strips and conducting link strip having respective front ends tightly clamped on corresponding core wires of a power cord connected to the receptacle, so that the receptacle could be more conveniently assembled for use.

To achieve the above and other objects, the receptacle for extension cord according to the present invention mainly includes a housing, a set of metal conducting strips, and a control unit.

The housing is provided on at least one side with a plurality of axially spaced slot pairs and an opening located in front of the slot pairs, and on an inner surface of that side having the slot pairs with a plurality of axially extended channels corresponding to the slot pairs.

The set of metal conducting strips consists of at least a first metal conducting strip and a second metal conducting strip separately seated in the axial channels on the housing. The first and second metal conducting strips are provided between respective two ends with a plurality of clampers corresponding to the slot pairs on the housing, and the first metal conducting strip is directly connected to a first core wire of a power cord connected to a front end of the housing. The control unit consists of a key, a conducting link strip, and a conducting spring strip. The key is pivotally turnably mounted in the opening on the housing, and is provided at an inner side with a projection having a slit. The conducting link strip has a rear portion seated in the slit on the key and having a slit formed near a free end thereof, and a front portion fixedly located at a predetermined position in front of the opening on the housing with a free end thereof connected to a second core wire of the power cord. The conducting spring strip is a curved strip having a front end provided with a slit adapted to engage with the slit on the rear portion of the conducting link strip, and a rear end rotatably connected to a predetermined position behind the opening on the housing.

When the key of the control unit is pushed to pivotally turn in the opening on the housing, the conducting link strip is biased to contact with the front end of the second metal conducting strip, so that power is supplied from an external power source via the power cord and the conducting link strip to the second metal conducting strip.

The conducting spring strip elastically pulls the conducting link strip away from the second metal conducting strip when the key is not pushed, so that the receptacle is in an open-circuited state; or pushes the conducting link strip against the second metal conducting strip when the key is pushed, so that the receptacle is in a close-circuited state.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
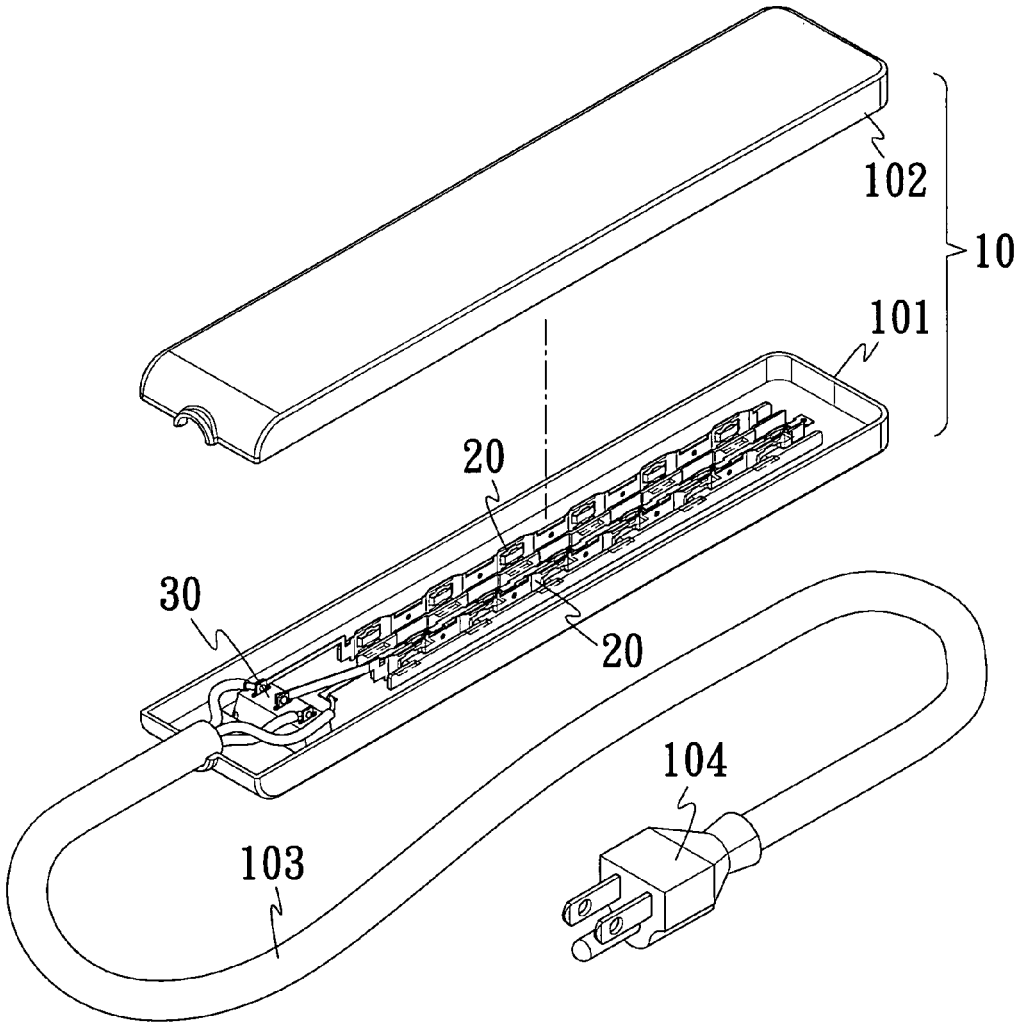
(PRIOR ART) Fig. 1
FIG. 1 is a partially exploded perspective view of a conventional receptacle for extension cord.
Figure 2:
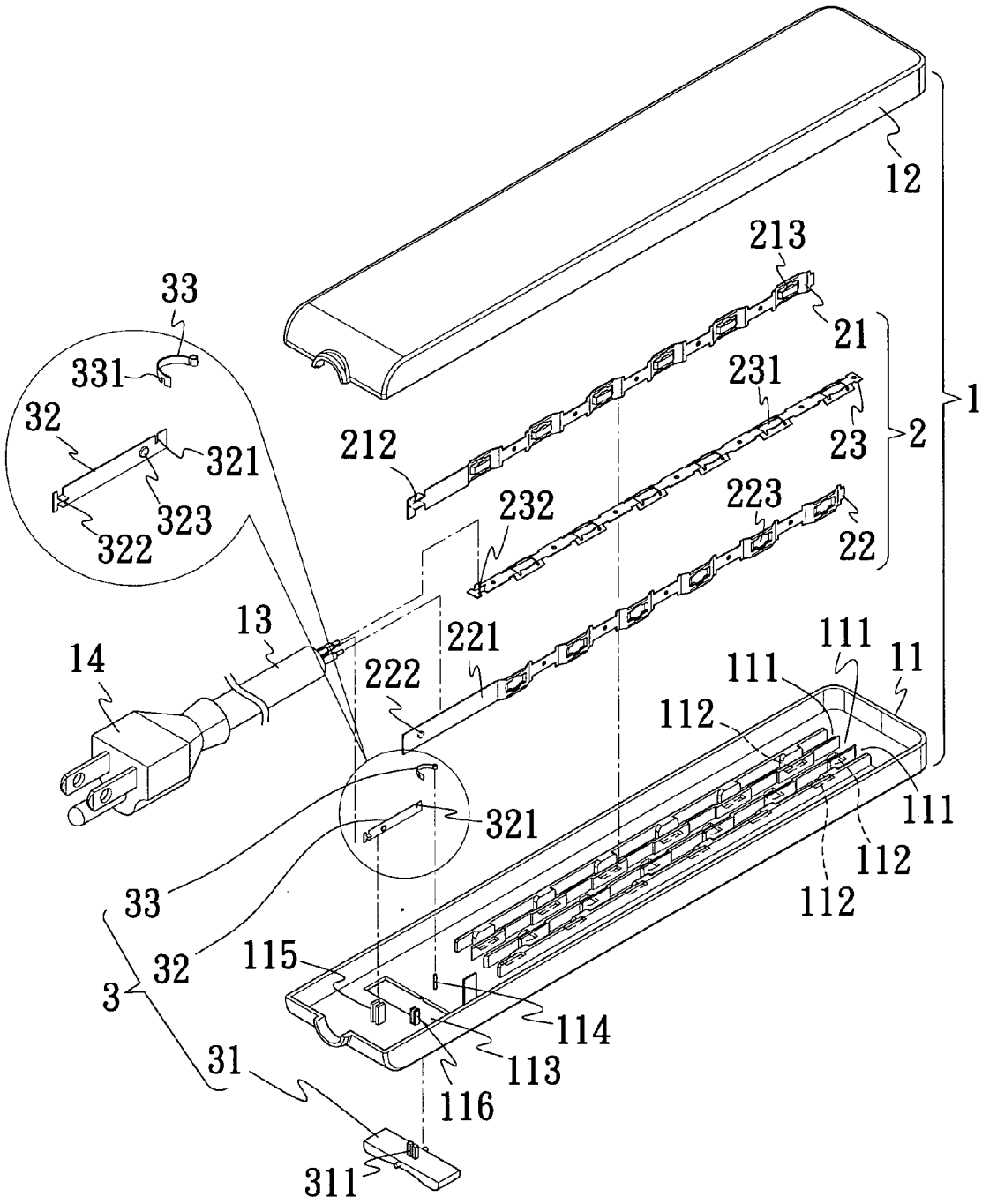
FIG. 2 is an exploded perspective view of a receptacle for extension cord according to an embodiment of the present invention.
Figure 3:
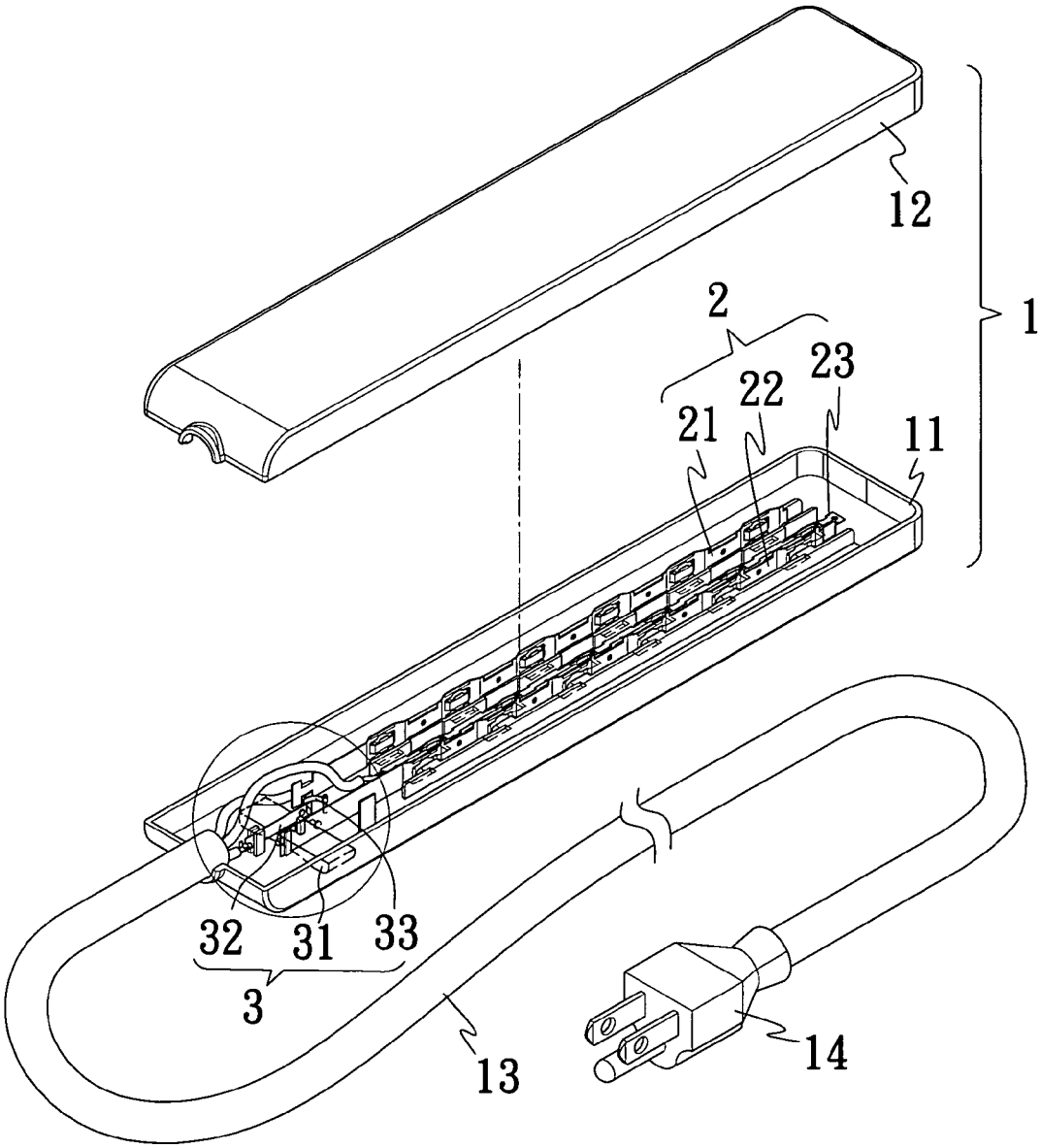
FIG. 3 is a partially assembled perspective view of the receptacle for extension cord of FIG. 2.
Figure 4:
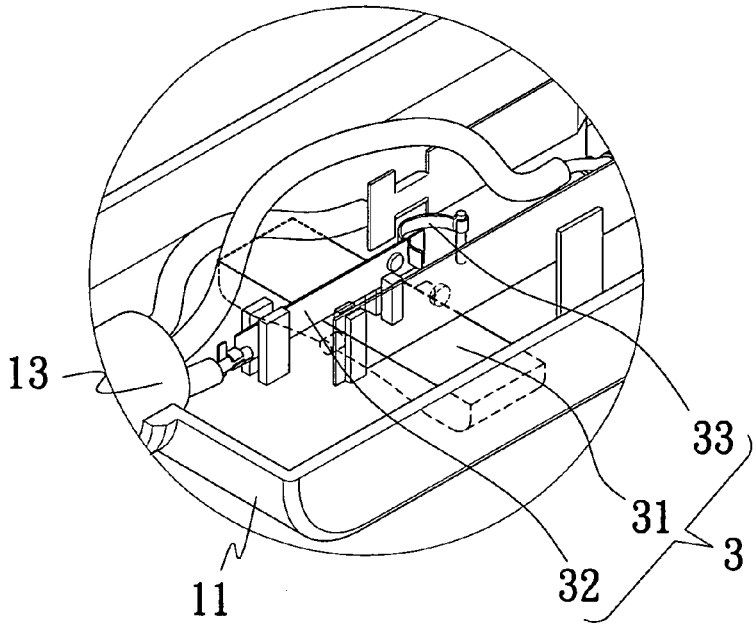
FIG. 4 is an enlarged view of the encircled area in FIG. 3 showing the control unit of the receptacle for extension cord according to the present invention.

Please refer to FIGS. 2 and 3 that are exploded and partially assembled perspective views, respectively, of a receptacle for extension cord according to an embodiment of the present invention, and to FIG. 4 that is an enlarged view of the encircled area in FIG. 3. As shown, the receptacle for extension cord of the present invention mainly includes a housing 1, a set of metal conducting strips 2, and a control unit 3.

The housing 1 includes a front cover 11 and a back cover 12 connected to each other. The front cover 11 is provided on an inner surface with a plurality of axially extended channels 11 divided by a plurality of parallel ribs. A plurality of slot pairs 112 are axially spaced on the front cover 11 with the two slots in one slot pair 112 located in two adjacent channels 111. An opening 113 is formed near a front end of the front cover 11 opposite to the channels 111 with a post 114 located between the opening 113 and the channels 111. The front cover 11 is also provided on the inner surface at one side of the opening 113 opposite to the post 114 with two projections, which are provided with a slit 115, 116 each. The housing 1 is connected at the front end to a power cord 13, a distal end of which is a plug 14 for connecting to an external power source.

The set of metal conducting strips 2 includes a first metal conducting strip 21, a second metal conducting strip 22, and a metal ground strip 23 separately seated in the channels 111 of the housing 1 with the metal ground strip 23 located between the first and the second metal conducting strips 21, 22. The first and the second metal conducting strip 21, 22, and the metal ground strip 23 are provided between respective two ends with a plurality of spaced clampers 213, 223, 231 corresponding to the slot pairs 112 on the front cover 11. The first metal conducting strip 21 and the metal ground strip 23 are provided at respective front end with a sideward clamping section 212, 232 having two clamping wings for clamping a corresponding core wire of the power cord 13 therebetween. The second metal conducting strip 22 is formed at a front end with an extended section 221 that forward extends across the opening 113 to locate in the slit 116 in front of the opening 113. The extended section 221 of the second metal conducting strip 22 is provided at a front inner side facing the first metal conducting strip 21 with a protruded dot 222.

The control unit 3 includes a key 31, a conducting link strip 32, and a conducting spring strip 33. The key 31 is pivotally turnably mounted in the opening 113 on the front cover 11, and has a projection with a slit 311 extended toward the back cover 12. The conducting link strip 32 has a front portion fixedly seated in the slit 115 in front of the opening 113. A free end of the front portion of the conducting link strip 32 is provided with a sideward clamping section 322 having two clamping wings for clamping a corresponding core wire of the power cord 13 therebetween. And, the conducting link strip 32 is provided near a rear end with a slit 321 and a protruded dot 323 facing toward the protruded dot 222 on the second metal conducting strip 22. The conducting spring strip 33 is a curved strip having a front end provided with a slit 331 adapted to engage with the slit 321 on the rear end of the conducting link strip 32 and thereby connects the conducting link strip 32 to the front end of the conducting spring strip 33. A rear end of the curved conducting spring strip 33 is rotatably connected to the post 114 behind the opening 113.

Figure 5:
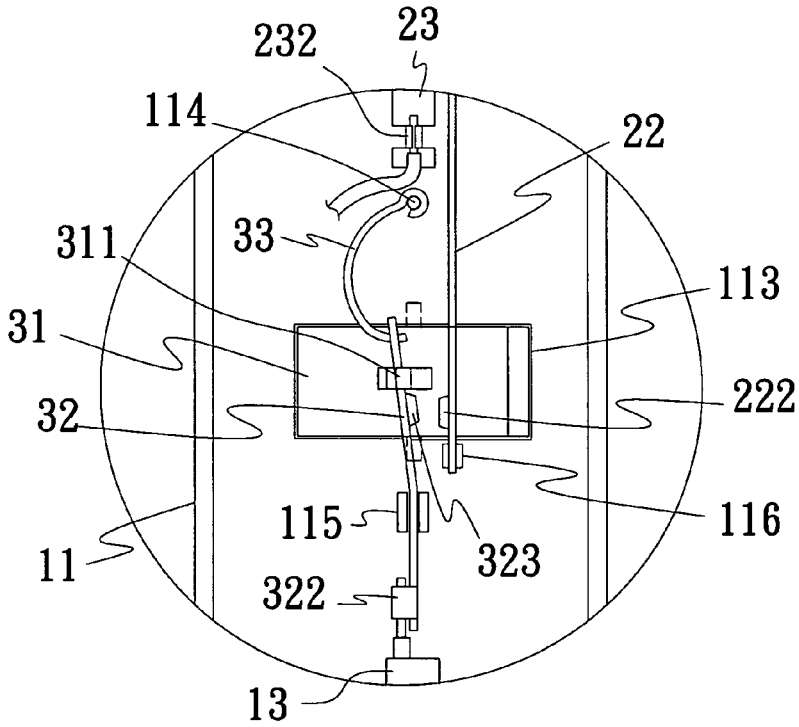
FIG. 5 is a plan view showing the control unit of FIG. 4 in an open-circuited state.
Figure 6:
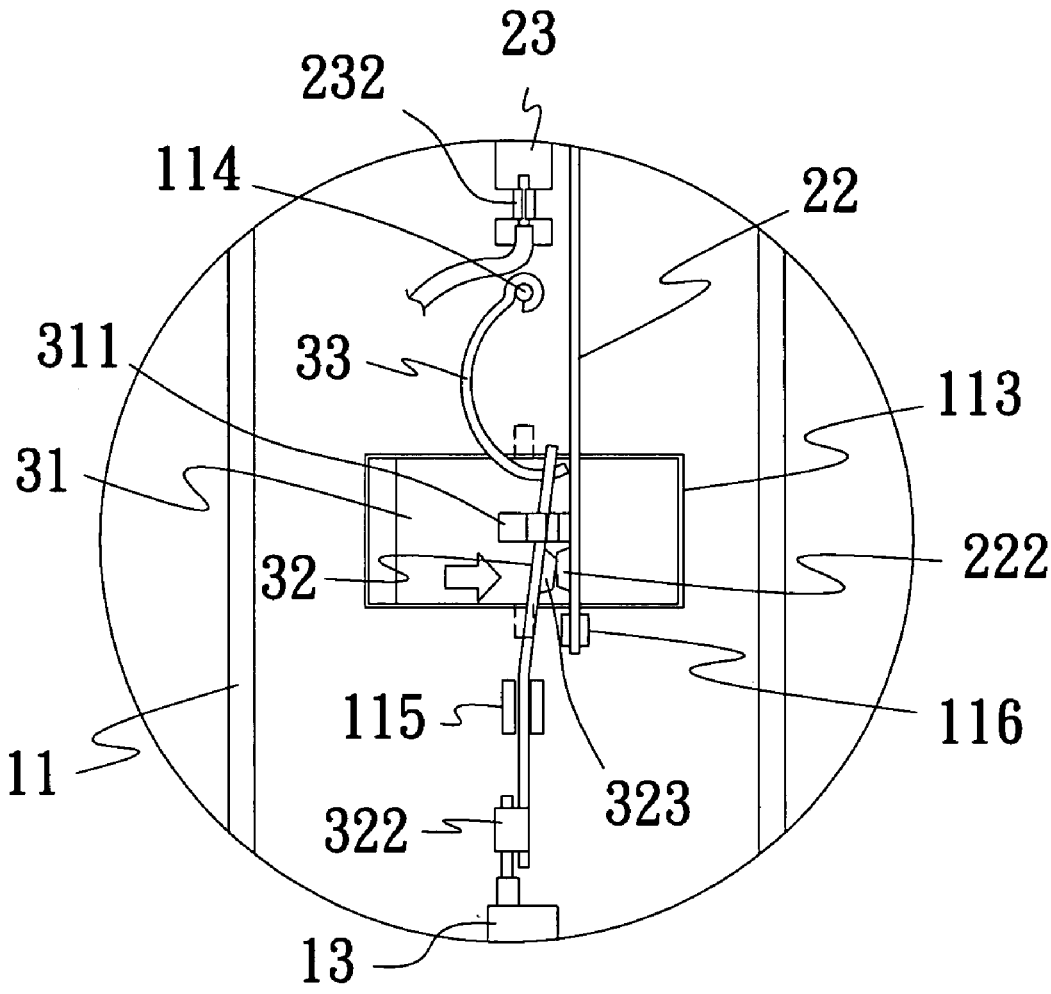
FIG. 6 is a plan view showing the control unit of FIG. 4 in a close-circuited state.

FIGS. 5 and 6 show the control unit 3 for the present invention in an open-circuited and a close-circuited state, respectively. When the key 31 of the control unit 3 is in a normal position without being pushed, as shown in FIG. 5, the conducting spring strip 33 elastically pulls the conducting link strip 32, which has a certain degree of elasticity, to a position separated from the forward extended section 221 of the second metal conducting strip 22. That is, the external power source is not supplied to the second metal conducting strip 22 via the power cord 13 and the control unit 3, and the receptacle for extension cord is in an open-circuited or OFF state. On the other hand, when the key 31 is pushed from outside of the receptacle and pivotally turned in the opening 113 as shown in FIG. 6, the slit 311 provided on the key 31 biases the conducting link strip 32 to cause contact of the dot 323 on the conducting link strip 32 with the dot 222 on the second metal conducting strip 22, so that the conducting link strip 32 is electrically connected to the second metal conducting strip 22. At this point, the conducting spring strip 33 is also brought to pivotally turn relative to the post 114 by a certain angle to hold the conducting link strip 32 in a position in contact with the second metal conducting strop 22. That is, the external power source is supplied to the second metal conducting strip 22 via the power cord 13 and the control unit 3, and the receptacle for extension cord is in a close-circuited or ON state.

What is claimed is:

1. A receptacle for extension cord, comprising:

a housing being provided on at least one side with a plurality of axially spaced slot pairs and an opening located in front of said slot pairs, and on an inner surface of that side having said slot pairs with a plurality of axially extended channels corresponding to said slot pairs;

a set of metal conducting strips consisting of at least a first metal conducting strip and a second metal conducting strip separately seated in said axial channels on said housing; said first and second metal conducting strips being provided between respective two ends with a plurality of clampers corresponding to said slot pairs on said housing, and said first metal conducting strip being directly connected to a first core wire of a power cord connected to a front end of said housing; and a control unit consisting of a key, a conducting link strip, and a conducting spring strip; said key being pivotally turnably mounted in said opening on said housing in front of said slot pairs, and being provided at an inner side with a projection having a slit; said conducting link strip having a rear portion seated in said slit on said key and having a slit formed near a free end thereof, and a front portion fixedly located at a predetermined position in front of said opening on said housing with a free end thereof connected to a second core wire of said power cord; and said conducting spring strip being a curved strip having a front end provided with a slit adapted to engage with said slit on said rear portion of said conducting link strip, and a rear end rotatably connected to a predetermined position behind said opening on said housing.

2. The receptacle for extension cord as claimed in claim 1, wherein said set of metal conducting strips further consists of a metal ground strip directly connected to a ground wire of said power cord.

3. The receptacle for extension cord as claimed in claim 1, wherein said first metal conducting strip and said conducting link strip are provided at respective front end with a sideward clamping section having two clamping wings for clamping said first and said second core wire of said power cord, respectively, between said two clamping wings.

4. The receptacle for extension cord as claimed in claim 2, wherein said first metal conducting strip, said metal ground strip, and said conducting link strip are provided at respective front end with a sideward clamping section having two clamping wings for clamping said first core wire, said ground wire, and said second core wire of said power cord, respectively, between said two clamping wings.

5. The receptacle for extension cord as claimed in claim 1, wherein said conducting link strip and said second metal conducting strip are correspondingly provided at two opposing and detachably contactable positions with a protruded dot each.

6. The receptacle for extension cord as claimed in claim 2, wherein said conducting link strip and said second metal conducting strip are correspondingly provided at two opposing and detachably contactable positions with a protruded dot each.

* * * * *